US006657115B1

(12) United States Patent
Egorov et al.

(10) Patent No.: US 6,657,115 B1
(45) Date of Patent: Dec. 2, 2003

(54) METHOD FOR TRANSFORMING CHORDS

(76) Inventors: Sergey Georgievich Egorov, Lenin av. 83, fl. 72, 344017 Rostov na Donu (RU); Alexandr Nikolaevich Putilin, Kirgizskaya str. 6, fl. 45, 344065 Rostov na Donu (RU); Maxim Olegovich Alexanian, Petrashevskogo str. 20, fl. 26, 344034 Rostov na Donu (RU); Gennady Jurievich Stashinov, Maly Koptevsky proezd, 4/6, fl. 47, 125315 Moscow (RU); Evgeny Nikolaevich Mishakin, Stachki av. 225, fl. 73, 344091 Rostov na Donu (RU); Sergey Nikolaevich Mishakin, Stachki av. 210, fl. 5, 344090 Rostov na Donu (RU)

( * ) Notice: Subject to any disclaimer, the term of this patent is extended or adjusted under 35 U.S.C. 154(b) by 0 days.

(21) Appl. No.: 10/049,826

(22) PCT Filed: Apr. 24, 2000

(86) PCT No.: PCT/RU00/00146

§ 371 (c)(1),
(2), (4) Date: Feb. 19, 2002

(87) PCT Pub. No.: WO01/15136

PCT Pub. Date: Mar. 1, 2001

(30) Foreign Application Priority Data

Aug. 23, 1999 (RU) ..... 99117853

(51) Int. Cl.[7] ..... G10H 1/38; G10H 7/00
(52) U.S. Cl. ..... 84/613
(58) Field of Search ..... 84/613, 637, 650, 84/400

(56) References Cited

U.S. PATENT DOCUMENTS 3,530,226 A 9/1970 Wheeler et al.
4,270,431 A 6/1981 Southard et al.
5,136,914 A 8/1992 Letts et al.
5,726,374 A 3/1998 Vandervoort
5,777,254 A * 7/1998 Fay et al. ..... 84/613
6,093,881 A * 7/2000 Fay et al. ..... 84/650

FOREIGN PATENT DOCUMENTS

DE 4216349 11/1993
RU 851454 8/1981

* cited by examiner

*Primary Examiner*—Jeffrey Donels
(74) *Attorney, Agent, or Firm*—Bachman & LaPointe, P.C.

(57) ABSTRACT

The invention relates to electronic musical instruments and more particularly to multi-voice electronic musical instruments employing chord transformation, i.e. instruments, which do not perform chords directly, but transform them to chords close in sound, but with different musical characteristics. The chord transforming method of the present invention includes receiving a close harmony input chord as a list of not less than 3 notes, generating open harmony resulting chord as a list of notes equal to or greater than the number of input notes, of the notes of the input chord included without changes and/or transposed to another octave, as well as outputting the resulting chord, comprises identifying the highest note of the input chord, which is then included in the resulting chord without changes and transposing every note of the subset of the notes to be transposed in such a way, that every transposed note is lower in pitch, than the highest note of the input chord. As a technical result, achieved in the process of working on the task, there have been developed a possibility for a performer of playing close harmony piano style chords and producing open harmony guitar like multi-voice (up to 6 voices) chords with melodic position (highest note of the chord) on its place. This lets a performer build open harmony multi-voice chord progressions with only one hand, controlling melodic and octave position of every output chord in a natural performing way, i.e. getting the resulting chord's highest note identical to that of the input chord.

6 Claims, 2 Drawing Sheets

| Method of chord transforming | 1 | 2 | 3 | 4 |
|---|---|---|---|---|
| M | C1,E1,G1 | E1,G1,C2 | G1,C2,E2 | |
| m | C1,Eb1,G1 | Eb1,G1,C2 | G1,C2,Eb2 | |
| 7 | C1,E1,G1,Bb1 | E1,G1,Bb1,C2 | G1,Bb1,C2,E2 | Bb1,C2,E2,G2 |
| m7 | C1,Eb1,G1,Bb1 | Eb1,G1,Bb1,C2 | G1,Bb1,C2,Eb2 | Bb1,C2,Eb2,G2 |
| 7,#5,b9 | E1,G#1,Bb1,C2,Db2 | Bb1,C1,Db2,E2,G#2 | | |

Method of chord transforming

| Method of chord transforming | 1 | 2 | 3 | 4 |
|---|---|---|---|---|
| M | C1,E1,G1 | E1,G1,C2 | G1,C2,E2 | |
| m | C1,Eb1,G1 | Eb1,G1,C2 | G1,C2,Eb2 | |
| 7 | C1,E1,G1,Bb1 | E1,G1,Bb1,C2 | G1,Bb1,C2,E2 | Bb1,C2,E2,G2 |
| m7 | C1,Eb1,G1,Bb1 | Eb1,G1,Bb1,C2 | G1,Bb1,C2,Eb2 | Bb1,C2,Eb2,G2 |
| 7,#5,b9 | E1,G#1,Bb1,C2,Db2 | Bb1,C1,Db2,E2,G#2 | | |

Fig. 2.

METHOD FOR TRANSFORMING CHORDS

BACKGROUND OF THE INVENTION

1. Technical Field of the Invention

The invention relates to electronic musical instruments and more particularly to multi-voice electronic musical instruments employing chord transformation, i.e. instruments, which do not perform chords directly, but transform them to chords close in sound, but with different musical characteristics.

2. Description of the Prior Art

Various prior art methods of transforming close harmony chords, playable with one hand on a piano keyboard, to open harmony guitar like chords with a larger number of notes are known to be employed in keyboard based musical instruments, making it possible to emulate plucked string instruments. One of the most popular methods of chord transforming is explained in description of the electronic musical instruments (see description in U.S. Pat. No. 4,379,420, Adaptive strum keying for a keyboard electronic musical instruments). This method comprises analyzing a chord played on a keyboard, identifying its type and root note, then choosing the output chord from a previously created chord table, which matches the chord type and root note. This method does not consider melodic position of the input chord, i.e. its inversion and octave position on the keyboard, which simplifies the procedure of playing chords for the performer, but at the same time creates many significant problems as the performer does not have a possibility of controlling some very important musical characteristics of the output chords, such as their melodic position, inversion and octave position. Another prior art method of chord transforming, technically quite close to the method of the present invention (see description in U.S. Pat. No. 3,967,520, Guitar chording device for keyboard instruments) comprises using all notes of the input chord for transformation and getting the output chord of the notes, playable as a guitar chord. Every note is chosen from 5 pre-assigned notes of the 5 guitar strings using a special priority system. However this known method also has some considerable problems. It does not consider the input chord's melodic and octave position, which makes controlling output chord's melodic and octave position impossible. Furthermore, the range of the upper notes of the output chord is limited to 5 of 12 available semitones even in 1 octave range, plus the method does not allow all types of output chords to employ root note in one of the bass strings, which definitely destroys the chord's harmonic color. The closest in technical aspects prototype to the method of the present invention is the method of chord transforming explained in U.S. Pat. No. 5,136,914, Stringed instruments emulator and method. This prior art method comprises the following scheme of transforming close harmony piano type chord to open harmony guitar like chord: the first received note of the input chord becomes the lowest or the highest note of the output chord, depending on whether the lowest or the highest string has been assigned as a controlling string for the chord. The rest of the notes are either left where they are, or transposed to another octave according to previously set parameters, such as open strings tuning, the number of used frets, pre-selected mode (open tuning or barred tuning). However since the input chord's octave position is not considered, the pitch of the resulting chord's highest note cannot be controlled by the performer. Furthermore, the prototype method does not guarantee the presence of root note in the lowest voices of the output chord. But the biggest problem of this method, along with all prior art methods, is their lack of controllability of voices leading in a chord progression, as well as impossibility of playing chords in required inversions, which is quite easy to achieve while playing on a real guitar by simply moving left hand along the neck. Also employing the above mentioned methods it is practically impossible to use more complex chord types with non-chordal or altered tones as they require controllability of voices leading, otherwise whole chord progression, even if every individual chord sounds harmonically accurate, may lose its musical sense.

SUMMARY OF THE INVENTION

The chord transforming method of the present invention includes receiving a close harmony input chord as a list of not less than 3 notes, generating open harmony resulting chord as a note list equal to or greater than the number of input notes, of the notes of the input chord included without changes and/or transposed to another octave, as well as outputting the resulting chord, comprises identifying the highest note of the input chord, which is then included in the resulting chord without changes and transposing every note of the subset of the notes to be transposed in such a way, that every transposed note is lower in pitch, than the highest note of the input chord. Furthermore, one of the preferred cases of the method of the present invention also comprises identifying root note of the input chord and transposing every note of selected subset of the notes to be transposed to another octave in such a way, that one of the 2 lowest notes of the resulting chord matches the root note of the input chord. In addition the method allows to identify input chord's alternative bass and transpose every note of the subset of the notes to be transposed in such a way, that one of the 2 lowest notes of the resulting chord matches the input chord's alternative bass. Along with the above-described way the initiation of the input chord can be performed by receiving its root note, chord type and highest note. The task the developers saw for themselves was to create a method of chord transforming, which would let a non-guitar type electronic musical instrument performer emulate the performance of a plucked string instrument with great simplicity and realism, and also let one musician emulate ensemble performance by playing several musical parts simultaneously using the sounds of various instruments with great simplicity and realism, previously assigned different musical instruments' sounds to different voices of the output chord. As a technical result, achieved in the process of working on the task, there has been developed a possibility for a performer of playing close harmony piano style chords and producing open harmony guitar like multi-voice (up to 6 voices) chords with melodic position (highest note of the chord) on its place. This lets a performer build open harmony multi-voice chord progressions with only one hand, controlling melodic and octave position of every output chord in a natural performing way, i.e. getting the resulting chord's highest note identical to that of the input chord. This is extremely important for a performer, as the choice of every chord's melodic position is essential while creating any chord progression, where the upper voice, i.e. melodic line of the highest notes, is the most characteristic and recognizable element of voices leading, bringing all individual chords into a musical form. During the performance of a chord progression as, for instance, a guitar accompaniment to vocal, the choice of chord positions played by the guitarist is extremely important for musical quality of the piece and is carefully thought by the composer or producer, as the melodic line of chords' highest notes represents important counter point to the lead melody.

Proofs of the realization possibility of chord transforming using the method of the present invention are given below. In particular the method of the present invention can be realized in a described below electronic keyboard musical instrument allowing to emulate guitar and ensemble performance.

BRIEF DESCRIPTION OF THE DRAWINGS

The method of the present invention can be represented graphically in the following way, where:

FIG. 2 shows the table of various chord types inversions with root note C.

DESCRIPTION OF THE PREFERRED EMBODIMENT

Figure 1:
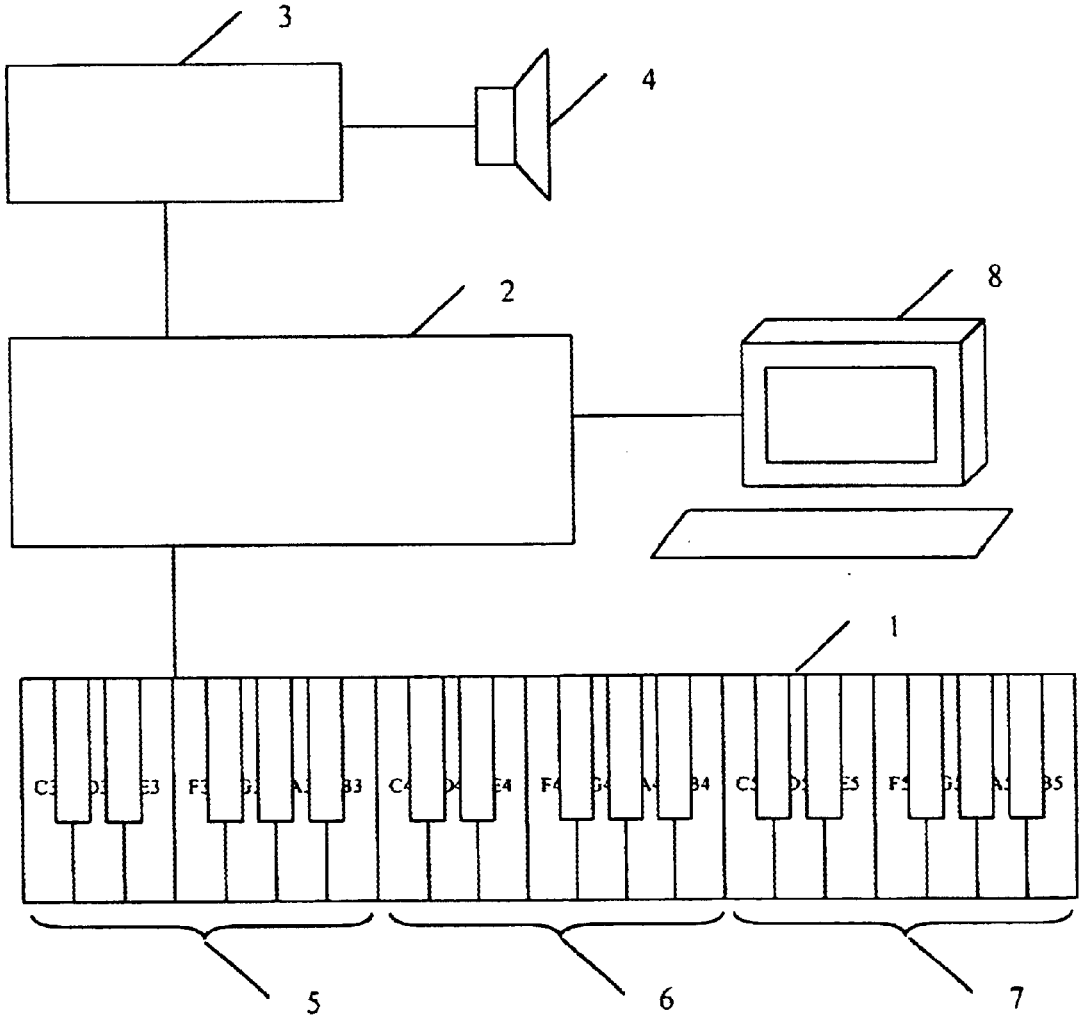
FIG. 1 shows the schematic of an electronic keyboard musical instrument employing the method of the present invention.

The electronic keyboard instrument employing the method of the present invention includes a piano type keyboard 1 for inputting chords and commands for playing sounds. The keyboard 1 is connected to microcomputer 2 for transmitting key action data (note-on/off and key velocity) to the latter. The microcomputer 2 processes the data received from the keyboard, creates the resulting chord and outputs the producing sound commands to sound module 3. Processing of the above mentioned data is performed by software pre-installed to the microcomputer 2, which transforms chords using the method of the present invention. The sound module 3 is connected to speaker 4, which plays acoustic sound output from the sound module 3. Keyboard 1 is virtually split into zones 5, 6 and 7. Zone 5 keys are assigned for selecting input chords, while zone 6 and 7 keys serve for triggering output chords. Graphic terminal 8 is connected to the microcomputer 2 and serves for alternative initiation of input chord by selecting its type and root note, as well as its highest note, and for transmitting this data to the microcomputer 2. It is necessary to mention that keyboard 1 and sound module 3 can be connected to the microcomputer using any digital protocol, including standard ones, such as MIDI or ZIPI. Also keyboard 1 as an input device, as well as sound module 3 as an output device, can be replaced by any electronic device supporting available protocols, for instance, a computer or a hardware sequencer.

Performing on the above described electronic musical instrument realizing the method of the present invention supposes controlling the instrument from keyboard 1, virtually split into zones 5, 6 and 7, so that performer's left hand operates the zone 5 keys, whose data is transmitted to the microcomputer's memory making up an input chord list. Holding the zone 5 keys, the performer presses zone 6 or 7 keys, whose data is transmitted to the microcomputer 2. On receiving note-on and velocity data from zone 6 or 7 keys, provided the input chord's note list contains not less than 3 notes, the microcomputer 2 generates an open harmony resulting chord as a note list equal to or greater than the input notes, of the input chord's note list included without changes and/or transposed to another octave, which then heads to the microcomputer's memory. It is necessary to emphasize that generating a resulting chord is performed in the following way: firstly the highest note of the input chord is identified, which then is included in the resulting chord without changes, then the input chord is classified according to its interval content and in the preferred case its root note and alternative bass being detected. According to this classification the subset of the input chord notes to be included in the output chord without changes, as well as the subset of the input chord notes to be transposed in the output chord are identified. The notes of the latter subset are transposed to another octave in such a way, that every transposed note is always lower in pitch than the input chord's highest note. In the most preferred case one of the 2 lowest notes of the resulting chord matches the root note of the input chord, while the other lowest note matches the chord's alternative bass. Another way of initiating the input chord's note list is also available, which supposes assigning chord by selecting its type and root note, as well as its highest note on the graphic terminal 8. This data is transmitted to the microcomputer 2 being considered an input chord, which is then processed in the above-mentioned way to create the resulting chord. Generation of the input chord's note list based on the data received from graphic terminal 8 is performed according to previously created chord table, shown in FIG. 2 in the following way: lines refer to chord types, while columns refer to chord inversions. Every cell of the table contains a note list of a chord of a certain type in certain melodic position, i.e. with a certain chord note in the upper voice, all chords have root note C. The microcomputer 2 selects the line of the table, according to the input chord type data received from the graphic terminal 8, then the cell of the line containing chord inversion and its note list according to the root note and the highest note data received from the graphic terminal 8. Then the microcomputer 2 transposes the notes of the list in such a way, that the highest note matches the highest note of the chord received from the graphic terminal 8, and generates the resulting chord's note list. In this case the assigned chords are displayed on the terminal, and zone 5 keys serve for choosing the chords sequentially. Chord change may also be performed automatically. Depending on a pressed zone 6 or 7 key the microcomputer 2 sends the play sound commands to sound module 3 according to the subset of resulting chord notes stored in the memory. Zone 6 keys trigger all resulting chord notes played simultaneously, while every key of zone 7 is used to trigger each respective chord note individually. So, in the most preferred case one of zone 7 keys is assigned to trigger root note of the resulting chord, other key triggers its alternative bass and the others are assigned to trigger the other resulting chord notes according to their pitch. In other words, a certain key is assigned for playing the resulting chord's highest note, other key for playing its second highest note and so on. Velocity of zones 6, 7 key pressing defines the loudness of the notes played by sound module 3. It is possible to assign different musical instruments timbres to separate keys of zone 7 to play respective resulting chord voices with different instrument sounds.

Below are some examples of performing on the above-described instrument allowing to demonstrate the use of chord transforming method of the present invention.

EXAMPLE 1

Chord Transformation

On holding the C3, E3 and G3 keys in zone 5 with the left hand, pressing the C4 key of the zone 6 with the right hand causes the microcomputer 2 to identify the chord's root note C according to the input chord's note list C3, E3, G3 and its alternative bass G, as well as generate the resulting chord G1, C2, G2, C3, E3, G3. The transformation of the input chord to the resulting chord is performed in the following way: firstly the chord's highest note G3 is identified and included without changes in the resulting chord, next the C3 and E3 notes are identified as the subset of the input chord notes to be included in the resulting chord without changes, and then the notes C3, G3, G3 are identified as the subset of the input chord's notes to be transposed. C3 and G3 are transposed down an octave adding C2 and G2 to the resulting chord, plus G3 is transposed down 2 octaves and adds G1 to the resulting chord. Thus one of the 2 lowest notes of the resulting chord, C2 matches the earlier identified root note C of the input chord, while G1 matches earlier identified alternative bass G of the input chord. On generating the resulting chord's note list, the microcomputer 2 sends commands to sound module 3 to simultaneously play the chord notes G1, C2, G2, C3, E3, and G3.

EXAMPLE 2

Assigning an Input Chord From the Graphic Terminal 8

On the graphic terminal 8 the major chord type (M), root note F and highest note A3 can be selected. Now in the chord inversion table (see FIG. 2) the microcomputer 2 finds the line matching the selected chord type (line 1) and the column matching chord inversion (column 3), since the interval between the chord's root note F and that of the table (C) is pure 4th (5 semitones), so the highest note A3 transposed by pure 4th (5 semitones) down makes E3, and the column 3 of line 1 contains the list of notes with the highest note E2. The cell just identified contains the following chord inversion's note list: G1, C2, and E2. The microcomputer 2 transposes the notes so that the highest note of the list (E2) matches the selected one (A3), which makes up the note list containing C3, F3, A3, which now serves as an input chord to be transformed to the resulting chord using the above described method.

EXAMPLE 3

Producing Sound With Zone 7 keys

The following functions are assigned to zone 7 keys: C5 key triggers note respective to the root note of the input chord; D5 key triggers note respective to the alternative bass; A5 key triggers the upper (highest in pitch) note of the resulting chord, G5 key triggers the second highest in pitch note, F5 key triggers the third highest in pitch note and E5 key triggers the forth highest in pitch note of the resulting chord. On holding the C3, E3 and G3 keys in zone 5 with the left hand, pressing any of the zone 7 keys with the right hand causes the microcomputer 2 to generate the resulting chord G1, C2, G2, C3, E3, G3 and identify the input chord's root note C and its alternative bass G in the same way as described in example 1. Unlike the case in example 1, the microcomputer 2 sends play sound commands to the sound module 3 to play each note of the resulting chord individually in the following way: pressing A5 key triggers G3, the resulting chord's highest note, G5 key triggers E3, F5 key triggers C3, E5 key triggers G2. Since C2 of the resulting chord matches the root note (C) of the chord and G1 matches its alternative base (G), pressing C5 key triggers C2 and D5 key triggers G1.

COMMERCIAL APPLICABILITY

Therefore the chord transforming method of the present invention allows the performer, playing a closed harmony piano style chord (ranging about an octave) and containing a few notes (3 or 4), to get an open harmony guitar like chord spanning 2 or more octaves, containing 6 notes, the highest note of which is identical to that of the input chord, and to emulate 2 main guitar techniques of chord performing (guitar strumming and guitar picking) by pressing zone 6 or 7 keys with the right hand. Emulation of guitar strumming is achieved by pressing any zone 6 key, which emulates a guitarist's right hand striking all the strings of a virtual guitar, which makes it possible to easily perform multi-voice chords with any necessary strumming rhythmic pattern and dynamic nuances by using only 2 fingers. Emulation of guitar picking is achieved by pressing zone 7 keys, which represent virtual analogy to guitar strings. This makes it possible to perform arpeggio of wide open harmony chords technically easily by pressing contiguous keys without changing hand position. At the same time the root note and alternative bass of any chord are always triggered by the 2 fix placed respective keys in zone 7, which makes a big difference for playing correct bass notes while performing this kind of technique. This method, along with chord legato transforming method and independent chord voices articulation (these are not described in this document), allows to perform more complex guitar textures, like 'bass and chord', 'melody, arpeggio and bass', 'melody, chord and bass' using zone 7 keys. Furthermore, there is an option of assigning different timbres to every zone 7 key and playing individual resulting chord voices with different musical instrument sounds, which allows a single performer to emulate not only guitar, but also multi-timbre ensemble performance. For instance, the user can assign acoustic bass timbre to the keys triggering the root note and alternative bass of the chord, harmonica timbre to the key triggering the highest note of the chord, and guitar timbre to the others. Now selecting chords with the left hand and pressing respective zone 7 keys with the right hand will cause acoustic bass and guitar parts to be played simultaneously, along with harmonica sound playing the melody. At the same time there is a possibility of additional assigning various drum sounds to zone 7 keys, which are then directly played on pressing respective keys independently from the left hand. This allows to perform additional accompanying drum pattern along with the above mentioned instrumental parts (bass, guitar, and harmonica). Thus playing on the instrument using the method of the present invention, a single performer gets unique possibility of producing 4-part ensemble performance playing 4 different instruments simultaneously.

What is claimed is:

1. A method of chord transforming, including the steps of: receiving a close harmony input chord as a note list of not less than 3 notes; generating an open harmony resulting chord as a list of notes at least equal to a number of input chord notes without changes; outputting a resulting chord; identifying a highest note of the input chord including the highest note in the resulting chord without change; and transposing every note of a subset of notes of the input chord to be transposed to another octave so that all transposed notes are always lower in pitch than the highest note of the input chord.

2. A method as in claim 1, further including identifying a root note of the input chord and transposing every note of the subset of notes of the input chord to another octave so that one of two lowest in pitch notes of the resulting chord matches the root note.

3. A method as in claim 1, further including identifying an alternative bass of the input chord, transposing every note of the subset of notes of the input chord to another octave so that one of two lowest in pitch notes of the resulting chord matches the alternative bass.

4. A method as in claim 1, further including initiating receipt of the input chord by selecting a type for the input chord and root note as well as the highest note of the input chord.

5. A method according to claim 1, wherein said generating step comprises generating said open harmony resulting chord as a list of notes greater than a number of input chord notes without changes.

6. A method according to claim 1, wherein said generating step comprises generating said open harmony resulting chord as said list of notes without transposition to another octave.

* * * * *